United States Patent [19]

Schaar

[11] Patent Number: 4,706,965

[45] Date of Patent: Nov. 17, 1987

[54] ARROW AND COMPONENTS THEREOF

[76] Inventor: John Schaar, 1048 W. Greenway Dr., Tempe, Ariz. 85282

[21] Appl. No.: 739,518

[22] Filed: May 31, 1985

Related U.S. Application Data

[62] Division of Ser. No. 493,958, May 12, 1983, Pat. No. 4,533,146.

[51] Int. Cl.[4] ..... F41B 5/02

[52] U.S. Cl. ..... 273/416

[58] Field of Search ..... 273/416, 419–423, 273/DIG. 23; 138/DIG. 11, DIG. 2

[56] References Cited

U.S. PATENT DOCUMENTS

| | | | |
|---|---|---|---|
| 2,288,562 | 6/1942 | Birkhofer et al. | 273/416 |
| 2,747,876 | 5/1956 | Teller | 273/420 |
| 3,787,051 | 1/1974 | Johns | 273/DIG 23 X |
| 4,173,670 | 11/1979 | Van Auken | 138/DIG. 2 X |
| 4,234,190 | 11/1980 | Airhart | 273/DIG. 23 X |
| 4,399,992 | 8/1983 | Molitor | 273/DIG. 23 X |
| 4,505,479 | 3/1985 | Souders | 273/DIG. 23 X |

FOREIGN PATENT DOCUMENTS

| | | | |
|---|---|---|---|
| 956738 | 9/1982 | U.S.S.R. | 138/DIG. 11 |

OTHER PUBLICATIONS

Archery 12–1975, p. 7, Graphflite Arrows.

*Primary Examiner*—Paul E. Shapiro

*Attorney, Agent, or Firm*—Don J. Flickinger; Jordan M. Meschkow

[57] ABSTRACT

An improved arrow system comprises an arrow shaft having first and second tubular end sections each having substantially parallel inner and outer surfaces, and an intermediate tubular section which is fixedly coupled between the first and second tubular end sections and having an inner diameter which is greatest at its ends and which decreases toward the longitudinal center of the intermediate section. An adjustable weight arrow point assembly co-operates with the first tubular end section while an adjustable weight self-aligning nock assembly co-operates with the second tubular end section.

1 Claim, 13 Drawing Figures

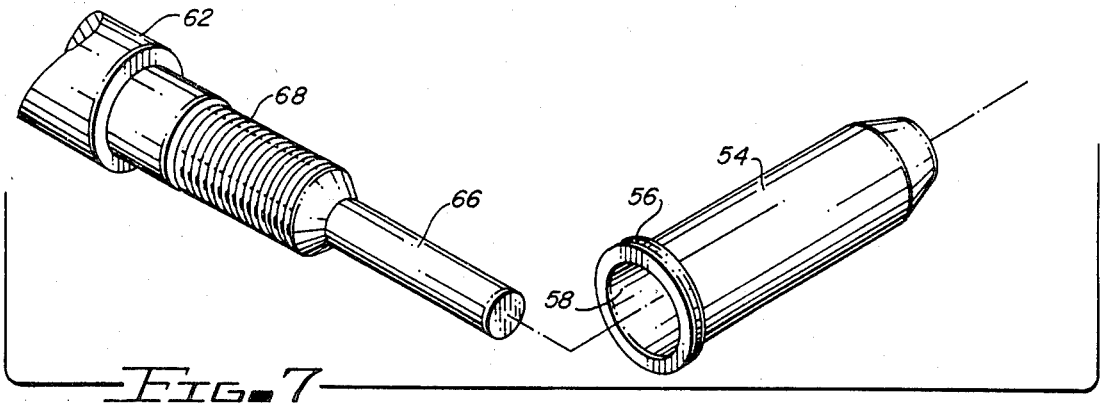
FIG. 7
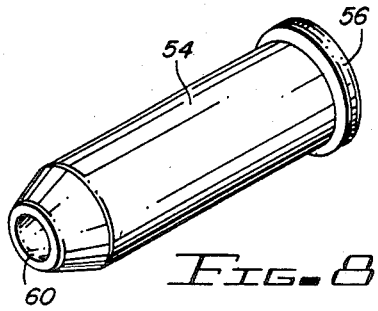
FIG. 8
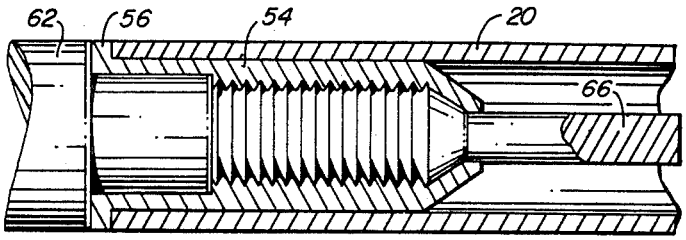
FIG. 9
FIG. 10
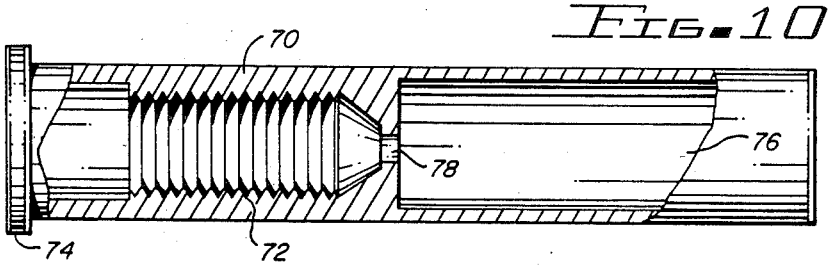
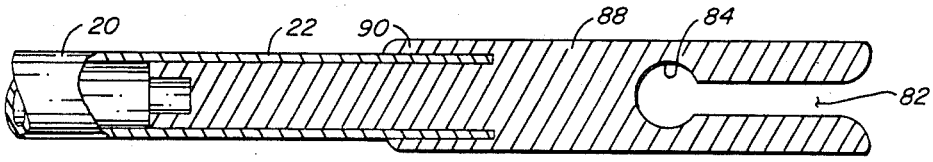
FIG. 11
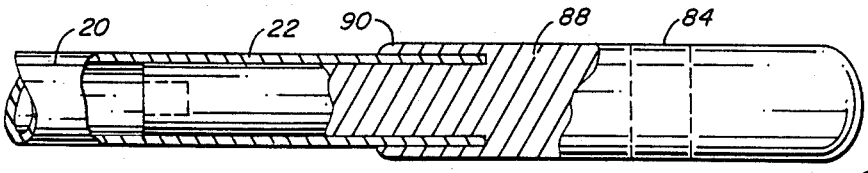
FIG. 12
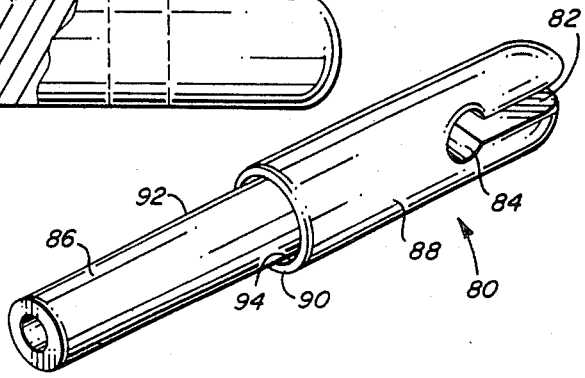
FIG. 13

ARROW AND COMPONENTS THEREOF

This application is a division of application Ser. No. 493,958, filed 12 May, 1983 now U.S. Pat. No. 4,533,146.

BACKGROUND OF THE INVENTION

1. Field of the Invention

This invention relates generally to an improved arrow and, more particularly, to an improved arrow system including an adustable weight point, a nock with an integral and ajustable weight insert, an improved shaft, and integral means for broadhead point alignment.

2. Prior Art

Primitive arrows generally consisted of reeds or branches and the points thereof generally comprised chipped stone.

Modern arrows, on the other hand, include shafts which may be solid wood, metal tubes, woven fiber shafts, or composites thereof.

Solid wood shafts may be manufactured from standard port orford cedar, compressed cedar doweling, compressed cedar with an attached hardwood foot, or a tapered outer diameter (barreled) solid wood shaft; i.e. having an outer diameter which is larger in the center section than it is at either end. These solid wood arrows generally include points which were formed of metal and glued on to the wood shaft.

The woven fiber shafts include fiberglass, graphite boron, or combinations thereof. These shafts exhibited an improved durability and consistency; however, in their less expensive forms (i.e. fiberglass) these arrows are relatively heavy and not uniformly straight. Some arrows of various materials are characterized by solid shafts (used mostly as "fishing" arrows). Also the shafts may comprise tubes having parallel and constant outer and inner diameters or may be tapered smaller towards the rear end of the arrow with uniform wall thickness. This results in an arrow which is fragile at the rear of the tube, very strong at the front end of the tube but too weak in the middle section of the tube. These arrows were made this way to simplify dismounting from a mandrel over which the fibers are wrapped during manufacture of the tube.

Metal tube shafts are durable, consistent, and are generally lighter and faster flying than arrows made of either solid wood or tubular fiberglass tubes. Metal arrows are generally manufactured of stainless steel or aluminum. Unfortunately, making metal shafts which exhibit a required stiffness generally meant making them heavier than desirable.

Metal tube shafts are generally characterized by uniform wall thickness having parallel and constant outer and inner diameters. Aluminum arrow shafts were used with increasing frequency when compound bows became popular around 1970. Compound bows made it possible for the average archer to draw and hold much heavier peak weights in drawing the bow, imparting greater thrust to the arrow shaft. This created a market for stiffer, lighter shafts than were possible when using either solid wood or fiberglass materials.

The metal shafts may be solid, or, as stated above, may comprise tubes having a uniform outer diameter and inner diameter. On the other hand, the tubes may be tapered toward each end (similar to the barreled shafts discussed earlier). These barreled shafts begin as shafts having a uniform wall thickness, however, a swedging process was employed that reduced the outside diameter at each end of the shaft and also thickened the wall of the tubes at the end of the shaft. Unfortunately, reinforcing is needed at the center of the shaft so as to stiffen the shaft against bending as it is being propelled from the bow.

Other metal and fiber shaft tubes have a uniform wall thickness but are tapered towards the rear of the shaft. These are typically swedged over a mandrel along its full length. The mandrel is then removed.

Finally, composite arrow shafts may include any of the already mentioned formations of solid or tubular structures and are made of combinations of various materials. For example, fiberglass and graphite, graphite and aluminum tubing, and aluminum tubing filled with styrofoam.

Throughout history, changes in arrow design have followed major changes in the design of bows used to propel the arrows. In some cases, major changes in arrow design have been delayed for long periods of time awaiting advances in material technology.

Initially, arrows were made from reeds or branches and served very well at that point in time since bows in those early days were very inefficient and incapable of providing uniform performance. Accuracy was not that important since arrows were generally lofted into the air by the thousands to fall upon the enemy from above. Individual targets were the exception rather than the norm.

During the period from about 1916 to 1935, bows of the "long bow" type were becoming more consistent in performance due to the use of better wood shaping tools. Thus, more uniform arrows were required. Since archery, at this time, was recreational in nature, individual accuracy had become of paramount importance. Arrows were shot "off the shelf" or sometimes using the top nuckle of the archer's bow hand as an arrow rest while the arrow was being drawn in aim. Bows were thickest at the point where the archer held them while shooting since this was the area under greatest stress and reinforcement was needed to reduce possibility of breakage. As a result, the arrow pointed off to the right or left of the target (depending on whether the archer was right or left handed). This led to what is commonly referred to as the "archer's paradox".

The "archer's paradox" relates to an arrow's attempt to have the point of the arrow and the rear tip of the arrow travel in the same straight line to the target even though the point started off to the right or left of the line between the archer and the target. The rear of the shaft, on the other hand, travels in a straight line down the center of the bow limbs and straight toward the intended target. As the back of the arrow travels straight toward the target with the bow string guiding it, the front of the arrow (the point) tries to bend around the bow and follow the same path toward the target that the rear end of the shaft is taking. This causes the arrow to bend in the center, usually too much so, so that by the time the string has completed its travel, the arrow is actually pointing to the opposite side of the target than it did when it started out. To offset this oscillation, feathers were added to the rear of the shaft to create a parachute effect; i.e. dragging the rear of the shaft in a straight line toward the center of the target. This, in effect, amounted to "steering" the arrow from the rear until the shaft column itself was free of oscillation and traveling in a straight line to the target.

With respect to the shaft column itself, care had to be taken to assure that the exact amount of stiffness be built into the shaft column itself. If the sahfts were too stiff, the column would not bend enough around the bow to travel straight to the target, and if the shaft were not stiff enough, the feathers would not be able to pull the arrow back in line for the target. This posed some involved porblems for arrow makers due to the fact that a great number of variables are involved. Each bow imparts a different amount of thrust to the arrow, and small changes in bow thrust could render an arrow that shot perfectly from one bow useless when shot from a bow with a different thrust.

From about 1935 to 1945, changes in bow designs again dictated improvements in arrow design. Bows of this period comprised laminations of two materials to create bows capable of imparting both greater amounts of thrust to the arrows in a more uniform manner. Laminations in and of themselves were not a new idea but were resurrected to be used in conjunction with new materials. For example, bows now became primarily laminations of hard rock maple sandwiched between sheets of fiberglass. The fiberglass added consistency and strength, prevented warpage, and resisted the bow's tendency to "take a set" when strung for extended periods of time.

As bows became more efficient, similar demands were placed on arrows. A popular shaft during this period was one of compressed cedar (although other shaft types were also available). The compressed shaft was straighter, less subject to warpage, and could accept greater amounts of stored energy from the bow while, at the same time, rendering more consistent results.

Bows of this period also began to use a "shelf" for resting the arrow on while drawing and shooting. Bows also began utilizing a "grip" section for the first time which was cut into the wood handle. This was now possible since the fiberglass laminates added enough extra strength to the bow handle so that removal of some material in this area did not unreasonably weaken the bow or render it prone to breakage. This "shelf" was, in reality, hardly more than a notch, and therefore arrow design and manufacture still had to take the archer's paradox into account.

Between 1945 and 1969, the "recurved" style of bows was resurrected to take advantage of the new materials and laminating technologies then available. The combination of recurve action and more modern materials and laminating technology increased the amount of stored energy in bows being transmitted to the arrows significantly so as to cause archers to seriously consider alternatives to wooden arrow material.

Bows of this period also extended the arrow "shelf" area into a somewhat larger area that became known as the "sighting window". Notwithstanding, bows continued to be made primarily of wood laminated between fiberglass covers. As a result, the "window" was generally still fairly shallow and the archer's paradox continued to be a factor in all arrow design.

During this period, some experimentation was under way dealing with bow handle sections made of metal. During this evolutionary period, two materials were considered to be serious contenders for arrows. These were (1) tubular aluminum and (2) tubular fiberglass. Both were more durable than wood and able to absorb energy from the bow more efficiently. However, both types of arrows were significantly higher priced since glass and aluminum technologies were at that time less sophisticated. Notwithstanding, it was still necessary to engineer into the shaft column the exact degree of stiffness necessary to accommodate the old archer's paradox.

The first "compound" bows made their first commercial ppearance circa 1969. Compound bows consist of a center "handle" section to which to extremely stout bow limbs are bolted. The limbs each have mounted on their tips an eccentric pulley system. Such arrangements permitted the average archer to use bows which were roughly twice as powerful as they had been able to use previously.

This served to rush the conversion from wood to fiber or metal arrows since inconsistencies in wood arrows appeared greatly magnified in degree when shot from bows providing twice the effective push on the arrow. Even at this stage, however, bows continued to be made primarily of wood and glass laminates in both the limb section and the handle or grip section. The wood cut-out "sight window" remained fairly shallow and arrow design continued to utilize the old archer's paradox formula. On the other hand, arrows increased in size so as to be compatible with and able to accept the increased thrust of compound bows.

In or about 1975, a simplifed version of a compound bow was introduced. It had a simpler pulley system and utilized cast aluminum for the handle section onto which the limbs and pulleys were bolted. This bow included a metal hand "riser" (grip section) to accommodate the compound bows need for greater strength handle material, and stouter limbs attched/bolted to the handle section. Through the use of new casting or forging technologies in manufacturing the "handle riser" section of the bow, the sight windows could be cut farther into the line of the bow handle center. In fact, some were cut past the center line of the bow handle. Thus, finally, it was no longer necessary to consider the archer's paradox in arrow design; however, the existing arrow manufacturers continued to do so. This may be due to the fact that they did not realize that the archer's paradox no longer represented a problem or it may be that manufacturer's chose to use their existing tooling to manufacture arrows. It may be speculated however that old technologies continued to be used to enable the manufacturer to sell more arrows since each size of arrows had a very limited range of bow draw weights over which it could be expected to perform well. Thus, very small changes in bow thrust made it necessary to buy all new arrows.

To impart a complete understanding, a few points should be made regarding arrow points, feathers (fletching), and nocks.

From primitive times to present, feathers have been useful to stabilize arrow oscillation in flight. These oscillations were introduced as a result of the archer's paradox accommodation in arrow shaft engineering. In recent times (since the 1960s), plastic replicas have found prominence as a substitute for turkey or other feathers as fletching materials.

Arrow points have evolved from chipped flint tied onto the shaft with raw hide to formed metal parts which are glued to the arrow and, most recently, to male screw-in tips which are seated in a female insert which is glued inside the tube forming the arrow shaft.

That portion of the arrow which accommodates the bow string is referred to as the nock and has evolved from hand carved notches in wooden shafts to plastic parts glued onto a wood taper or glued onto an insert in the arrow tube provided for the purpose of gluing a nock thereon.

Manufacturers of individual parts or components of the shooting system have, in the past, generally produced individually improved components without regard to their effect on other components in the system and the system in its entirety. In most cases, the effects on the overall shooting system performance were unknown or misunderstood.

Nevertheless, there are certain basic requirements for optimum performance which remain unchanged. First, the arrow must have adequate stiffness so as to absorb energy from the bow and not buckle in the center so severely as to become unstable in flight due to harmonic vibrations and oscillation. Second, they must be durable so as to be used and reused. Third, the arrow must be light enough to attain high speeds and heavy enough to prevent the bow limbs from retaining so much energy when the arrow is cast that the limbs are damaged when they slam to a stop at the end of the string's forward travel. This is tantamount to "dry firing" the bow and may cause severe damage to the bow. Fourth, and overlooked until relatively recently, it is extremely important that the arrow be properly balanced to attain good arrow flight. An arrow with too little weight at its front (point weight) will tend to tumble. Arrows must have extra weight at the front end to provide a guidance system for the remainder of the shaft in flight. Fifth, all other things being equal, if two arrows are shot from the same bow with the same initial thrust, the one lighter in mass weight will attain the higher velocity. However, as noted earlier, the arrow should not be so light as to allow the bow limbs to slam hard against the string at the end of its forward travel possibly damaging the bow itself.

SUMMARY OF THE INVENTION

It is an object of the present invention to provide an improved arrow system.

It is yet a further object of the present invention to provide an improved arrow shaft.

Yet another object of the present invention is to provide a universal arrow system which initially utilizes the same size shaft (tube) for all arrows.

It is a further object of the present invention to provide an improved arrow point assembly.

Still another object of the present invention is to provide an adjustable weight arrow point.

It is still a further object of the present invention to provide a method and apparatus for properly aligning broadhead arrow points.

Another object of the present invention is to provide an arrow having an improved nock.

It is a further object of the present invention to provide an arrow nock having an integral insert to assure proper nock alignment.

Still a further object of the present invention is to provide an adjustable weight nock.

It is a still further object of the present invention to provide a method of balancing an arrow so as to ensure consistent and efficient performance.

According to a broad aspect of the invention there is provided an arrow shaft including a first tubular end section having a first tubular end section having substantially parallel and constant inner and outer surfaces, a second tubular end section having substantially constant and parallel inner and outer surfaces, and an intermediate tubular section fixedly coupled between the first and second end sections, the intermediate section having a longitudinal bore therethrough with an inner diameter which decreases toward the longitudinal center of the intermediate section, the inner diameter being greatest adjacent the first and second end sections.

According to a further aspect of the invention there is provided an improved arrow shaft of the type which is adapted to be fitted with an arrow point at one end and a nock at an opposite end wherein the improved arrow shaft comprises a tubular shaft having a longitudinal bore therethrough having an inner diameter which is greatest at the ends of the shaft and decreases towards its longitudinal center.

According to a still further aspect of the invention there is provided an adjustable weight arrow point assembly which includes a point, a rod coupled to the point and extending rearward thereof, the rod being trimmable so as to vary the weight of the point assembly, a generally tubular insert adapted to be positioned within an end of the arrow shaft, and means for securing the rod within the insert.

According to a still further aspect of the invention there is provided an apparatus for aligning an arrow point within an arrow shaft including, a rod fixedly coupled to the point and extending rearward thereof, a generally tubular insert adapted to be positioned within an end of the shaft, the insert including a plurality of longitudinal grooves in an inner surface thereof, and a tubular sleeve fixedly coupled to and surrounding a portion of the rod adjacent the point, the sleeve including a plurality of longitudinal projections on an outer surface thereof which are received and retained by the grooves when the sleeve is positioned within the insert.

According to another aspect of the invention there is provided an apparatus for aligning an arrow point on an arrow shaft including, a generally tubular internally threaded insert adapted to be positioned within an end of the shaft, and a cylindrical externally threaded portion fixedly coupled behind the point which threadably engages the insert to align the point.

According to yet another aspect of the invention there is provided a self-aligning nock for use in conjunction with a cylindrical arrow shaft having at least a hollow end portion, including a first generally cylindrical section having a transverse notch in one end thereof, and a second generally cylindrical section extending from an opposite end of the first section and formed integrally therewith and adapted to be inserted into the hollow end so as to align the first section.

According to a further aspect of the invention there is provided an improved arrow system of the type which includes a shaft, a point and a nock; the improvement comprising: an arrow shaft including a first tubular end section having substantially parallel inner and outer surfaces, a second tubular end section having substantially parallel inner and outer surfaces, and an intermediate tubular section fixedly coupled between the first and second tubular end sections and having an inner diameter which is greatest at its ends and decreases towards the longitudinal center of the intermediate section; an adjustable weight arrow point assembly for co-operating with the first tubular end section; and a self-aligning nock for co-operating with the second tubular end section.

According to a still further aspect of the invention there is provided a method of fabricating an arrow having a desired weight, said arrow including a shaft and point and nock assemblies having trimmable portions so as to vary their individual weights, the method comprising, determining where the longitudinal midpoint of the completed arrow resides on the shaft, and trimming the point and nock assemblies until a predetermined portion of the desired weight is accounted for by the portion of the completed arrow in front of the midpoint.

BRIEF DESCRIPTION OF THE DRAWINGS

The foregoing and further and more specific objects and advantages of the instant invention will become readily apparent to those skilled in the art from the following detailed description of a preferred embodiment thereof taken in conjunction with the drawings, in which:

FIGS. 7, 8 and 9 illustrates an alternate embodiment of an adjustable weight point assembly in accordance with the present invention;

FIG. 10 illustrates yet another embodiment of an adjustable weight point apparatus in accordance with the present invention; and FIGS. 11, 12 and 13 illustrate an adjustable weight self-aligning nock in accordance with the teachings of the present invention.

DESCRIPTION OF THE PREFERRED EMBODIMENT

Figures 1, 2, 3, 4, 5, 6:
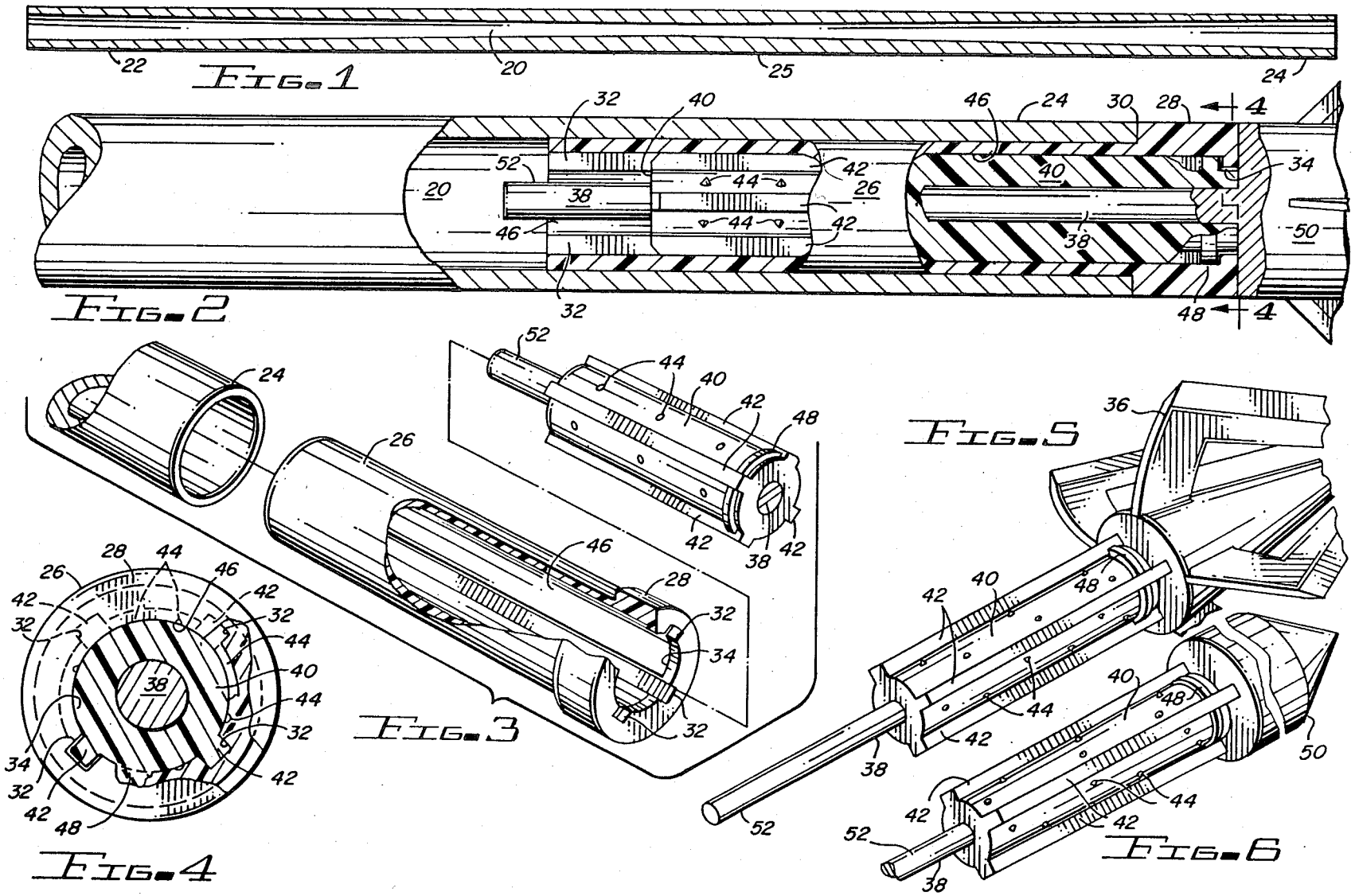
FIG. 1 is a cross-sectional view of an arrow shaft in accordance with the present invention.
FIG. 2 is a partial cross-sectional view of the inventive shaft having incorporated therewith an adjustable weight point and point alignment apparatus in accordance with the present invention.
FIG. 3 is an exploded view of the essential components shown in FIG. 2.
FIG. 4 is a cross-sectional view of the adjustable weight point shown in FIG. 2 taken along line 4—4.
FIG. 5 illustrates a broadhead arrow point in accordance with the present invention.
FIG. 6 illustrates a target point in accordance with the present invention.

An arrow's stiffness is a measure of its ability to absorb energy from the bow and remain stable in flight. The inventive arrow shaft shown in FIG. 1 is based on the fact that sight windows may be cut beyond the center line of the bow due to the very strong materials that are now available for use in bow handle sections. Thus, arrow designs no longer need accommodate the archer's paradox described above.

The inventive arrow shaft comprises a tube 20 (shown in cross-section form) which has first and second tubular end sections 22 and 24 respectively which have parallel and constant outer and inner diameters. These sections are necessary to accommodate the adjustable weight point assembly and selfaligning nock assembly to be described in more detail hereinbelow.

Beteween sections 22 and 24 is an intermediate section 25 the inner surface of which is tapered from each end towards the center making the wall of the tube thicker and thicker as the center of the intermediate section is approached. The entire shaft may be 34 to 35 inches in length having approximately six inch end sections. The thickness of the tube wall at the ends of the shaft may be from 0.010 to 0.020 inches thick while the wall of the tube may be from $1\frac{1}{2}$ to 4 or more times this thickness (depending on the strength and type of fiber material used) at the center of the intermediate section. This configuration substantially reduces if not eliminates the arrow's tendency to buckle (which tendency is greatest in the middle of the shaft when the shaft is pushed suddenly from the rear). Since little, if any, bending takes place in the inventive arrow shaft, fletching having less surface area is necessary to stabilize the downward range flight of an arrow constructed with the shaft shown in FIG. 1.

Using existing fabrication technology and materials (e.g. graphite, boron, aluminum, fiberglass and laminates thereof) it is possible to produce a single shaft column using the tapered wall principle shown in FIG. 1 that will perform perfectly for all bows that utilize sight windows cut adequately towards the center of the bow regardless of the type of bow (long bow, recurve or compound bow) or its draw weight. Furthermore, the length of the shaft may be modified by cutting portions off one or both ends so as to accommodate archers having different draw distances. Thus, by using various weight materials in construction of the shaft column shown in FIG. 1 and adjusting the overall arrow weight by trimming an adjustable length nock and point inserts as will be described fully below, a single arrow may be produced that is suitable for use on all modern bows by arched of various strength and reach.

Currently, the three primary types of bows which are in use are recurve bows, compound bows, and long bows, and each requires arrows of different weights to achieve optimum performance at a given peak draw weight. That is, long bow arrows require a weight of 6.5 to 7.5 (in grains) times the bow's peak draw weight in pounds of force. Recurve bows require arrows having a weight of 7 to 8 times (in grains) the bow's peak draw weight in pounds of force, and compound bows require arrows having a weight of 8 to 9 times (in grains) the bow's peak draw weight in pounds of force. Therefore, a 60 pound bow may require an arrow weight of 420 grains for a long bow, 480 grains for a recurve bow, and 540 grains for a compound bow. At these weights, the arrows will provide optimum limb loading and velocity (assuming the use of bows of equal efficiency).

Different weights are required for the following reasons. First, each bow imparts its force in a different fashion. Second, each bow has a different efficienty ratio in terms of how much of the 60 pounds of energy is transferred to the arrow. Finally, it may be necessary to add arrow weight at the expanse of lost velocity to avoid dry firing of the bow which would, in effect, occur if the arrow were too light.

As described earlier, the inventive arrow shaft uses less material at each end and is thickened only at the center thus providing the stiffness necessary to accommodate the bow's thrust. The arrow shafts may be made extremely light in weight by using current technologies to laminate light weight metals and/or fibers such as graphite, boron, aluminum, etc. By using adjustable weight points and inserts of the types shown in FIGS. 2–10 and an adjustable weight self-aligning nock of the type shown in FIGS. 11–13 in conjunction with the light weight shaft, the same shaft may be made to accommodate any of the above described bow types as well as any other bow variations which may be developed in the future. Thus, by adjusting the weight of the assembled arrow, an archer can, in effect, control the velocity of the arrows without altering the bow in any way regardless of the type of bow being used.

In order to achieve optimum flight, it is necessary to do more that simply adjust the overall weight of the arrow. It is known that optimum flight occurs when the front half of the arrow weights approximately 60% of the total arrow weight. it will be shown that balance between the front and rear halves of the arrow may be achieved after selecting all other arrow components simply by trimming the nock and point assemblies appropriately as will be described below.

FIGS. 2–6 illustrate an adjustable weight point assembly and means for aligning a broadhead arrow point. Referring to FIGS. 2–6 collectively, there is shown end 24 of arrow shaft 20. A tubular plastic insert 26 having an annular flange portion 28 at one end thereof is inserted into end 24 of shaft 20 until flange portion 28 abuts against the end of shaft 20 as is shown at 30. As is shown more clearly in FIG. 3, insert 26 is provided with a plurality (e.g. 4) of longitudinal grooves 32. Furthermore, plastic insert 26 is provided with an angular groove 34 which is located very near the front portion of insert 26. Insert 26 may be approximately 3–4 inches in length, and angular groove 34 may have a depth of approximately 0.001 to 0.002 inches.

FIG. 5 illustrates a broadhead point assembly comprising point section 36, metal shaft or rod 38 which is fixedly coupled to point 36, and a plasic sleeve 40 which surrounds the forward portion of shaft 38. As can be seen, sleeve 40 is equipped with longitudinal projections 42 which correspond in number to the number of grooves 32 in insert 26. Sleeve 40 is also provided with a plurality of small projections 44 protruding from its outer surface. Shaft 38 may be approximately six inches in length and weigh 60 to 90 grains (depending on the diameter and density of the metal used).

As is shown in FIG. 2 and FIG. 4, the point assembly shown in FIG. 5 may be positioned within insert 26 such that longitudinal projections 42 are received by groove 32. Projections 44 frictionally engage inner surface 46 of insert 26. The point assembly is inserted into insert 26 until an annular projction 48 on sleeve 40 is receved by annular groove 34. In this manner, the arrow assembly is positioned angularly by projections 42 co-operating with grooves 32 and is positioned longitudinally by the frictional force exerted against the inner surface 46 of the sleeve 26 by projections 44 on sleeve 40 and also is retained longitudinally by angular projection 48 on sleeve 40 residing within angular groove 34 in the inner surface 46 of insert 26.

While the angular positioning of broadhead points of the type shown in FIG. 5 is critical with respect to alignment with the arrow's nock and fletching, such angular alignment is not necessary when target points such as those shown in FIG. 6 are utilized. Thus, the target point assembly shown in FIG. 6 includes a target point 50 which is fixedly coupled to shaft 38 (as was broadhead point 36 in FIG. 5); however, in this case, sleeve 40 containing projections 44 and angular projection 48 is not provided with longitudinal projections 42. In this case, it is only necessary that the point assembly be longitudinally retained by projections 44 and 48 as described previously.

It is important to note that the weight of the point assemblies shown in FIGS. 5 and 6 may be adjusted by simply trimming (i.e. curring portions off) shaft ends 52. Also, insert 26 may be trimmed to vary its weight.

FIGS. 7–9 illustrate an alternative method of attaching point assemblies to the arrow shaft shown in FIG. 1. Referring to FIGS. 7–9, an internally threaded cylindrical insert 54 equipped with a flange 56 at one end thereof has a first opening 58 and a second tapered opening 60 of smaller diameter than that of opening 58. This insert is placed within arrow shaft 20 until flange 56 abuts against the end of the arrow shaft as is shown at 64. Point 62 is fixedly coupled to a metal shaft or rod 66 which is equipped with an externally threaded sleeve 68. The point assembly is attached to the arrow shaft by positioning metal rod 66 within aperture 60 of sleeve 54 and screwing sleeve 68 into insert 54 until all of the threads on sleeve 68 engage the internally threaded portion of sleeve 54 as is shown in FIG. 9. In this case also, the weight of the point assembly may be modified by simply trimming (i.e. cutting off) a portion of rod 66.

FIG. 10 illustrates yet another alternative insert which may be used to position a point assembly at one end of the arrow shaft. It is very similar to insert 54 shown in FIGS. 7 and 8 in that it comprises a cylindrical sleeve 70 having an internally threaded portion 72 and having an annular flange 74 at one end thereof. However, in addition to these components, the insert shown in FIG. 10 is provided with a tubular extension 76 which adds extra weight to the insert and may also be trimmed to adjust the weight at the front of the arrow. It should be clear that the point assembly of the type shown in FIG. 7 would be screwed into sleeve 70 with rod 66 passing through aperture 78 and extending into the interior of tubular extension 76.

FIGS. 11, 12 and 13 illustrate a self-aligning nock 80 in accordance with the present invention. As can be seen, nock 80 includes a notch 82 including a widened portion 84 to accommodate the bow string. Nock 80 also includes cylindrical projection or insert 86 which has an outer diameter which is incrementally smaller than the inner diameter of end 22 in arrow shaft 20 shown in FIG. 1 such that insert 86 may slide into end 22 of shaft 20 and be frictionally retained therein or permanently affixed with adhesive. While head portion 88 and cylindrical portion 86 are integrally formed, head portion 88 includes an annular lip 90 which extends over the outer surface 92 of cylindrical member 86 along a portion of its length thus leaving an angular space 94 between lip 90 and surface 92. This space is of sufficient dimension so as to frictionally receive end 22 of arrow shaft 20 as is shown in FIGS. 11 and 12. In this manner, nock 80 is automatically aligned with the centerline of the shaft. Furthermore, as was the case in the previously described point assemblies, the overall weight of the nock assembly may be adjusted by simply trimming cylindrical section 86 until a desired weight is achieved.

By employing the inventive arrow shaft, point assemblies and nock assembly, not only can the legth of the arrow be adjusted and its overall weight selected but the arrow may be balanced by properly trimming the point nock assemblies and/or inserts. That is, once the desired weight of the completed arrow has been determind, it is necessary only to locate the longitudinal midpoint of the completed arrow on its shaft, and trim the point and nock assemblies until a desired portion of the desired weight is accounted for by that portion of the arrow in front of the midpoint.

It must be remembered that the greatest bending moment and therefore the greatest susceptibility to irrepairable damage in an arrow occurs at the moment of impact, or when the arrow is gripped from the rear of the shaft and pulled from the target. The sections of the shaft which are most easily damaged are the true center, the impacting tip, and the rear of an arrow being withdrawn from a target. By using the universal arrow shaft system described above all of these areas are reinforced. That is, the center of the shaft has a thicker wall thickness, the impacting tip section is reinforced by use of an insert within the parallel inner diameter shaft section, and the rear of the arrow shaft is reinforced through the use of a nock insert within the parallel inner diameter rear section.

Various changes and modifications to the embodiment herein chosen for purposes of illustration will readily occur to those skilled in the art. To the extent that such variations and modifications do not depart from the spirit of the invention, they are intended to be included within the scope thereof which is assessed only by a fair interpretation of the following claims.

Having fully described and disclosed the present invention, and alternately preferred embodiment thereof, in such clear and concise terms as to enable those skilled in the art to understand and practice the same, the invention claimed is:

1. An arrow shaft, comprising:

a first tubular arrow shaft end section having substantially constant and parallel inner and outer surfaces;

a second tubular arrow shaft end section having substantially constant and parallel inner and outer surfaces; and an intermediate tubular arrow shaft section fixedly coupled between said first and second tubular arrow shaft end sections, said intermediate tubular arrow shaft section having a longitudinal bore therein with an inner diameter which decreases toward the longitudinal center of said intermediate tubular arrow shaft section, said inner diameter being greatest adjacent said first and second tubular arrow shaft end sections, the wall thickness of said intermediate tubular arrow shaft section being greatest near the center of said intermediate tubular arrow shaft section and tapering down toward said first and second tubular arrow shaft sections; said shaft being approximately thirty-five inches in length and said first and second tubular arrow shaft end sections are each approximately six inches long said first and second tubular arrow shaft sections being trimmable to alter the overall weight and length of the arrow shaft.

* * * * *